US005299689A

United States Patent [19]

Ledewitz

[11] Patent Number: 5,299,689

[45] Date of Patent: Apr. 5, 1994

[54] STACKABLE TOOTHPASTE TUBE

[76] Inventor: William Ledewitz, 31 Brookwood Dr., Woodbridge, Conn. 06525

[21] Appl. No.: 16,543

[22] Filed: Feb. 11, 1993

[51] Int. Cl.[5] ..... B65D 21/02

[52] U.S. Cl. ..... 206/503; 220/23.6; 222/107; 222/143

[58] Field of Search ..... 222/107, 92, 143; 220/23.6, 23.4, 23.2, 23.83, 23.86; 206/504, 503

[56] References Cited

U.S. PATENT DOCUMENTS 2,176,513 10/1939 Smith ..... 222/92
3,194,426 7/1965 Brown, Jr. ..... 222/143
4,693,396 9/1987 Tavss et al. ..... 222/107
4,986,053 1/1991 Schaefer ..... 222/107
5,080,260 1/1992 During ..... 222/107
5,125,537 6/1992 Slapin et al. ..... 222/143

*Primary Examiner*—Allan N. Shoap
*Assistant Examiner*—S. Castellano
*Attorney, Agent, or Firm*—Alfred E. Miller

[57] ABSTRACT

A blow-molded toothpaste tube being rectangular-oval in configuration for display without a carton, and having a bottom and top narrow, flat, parallel panels and wider front and rear panels for brand identification and indicia. The tubes are stackable horizontally on one of the narrow panels to a selected vertical height on a shelf.

4 Claims, 2 Drawing Sheets

FIG.1
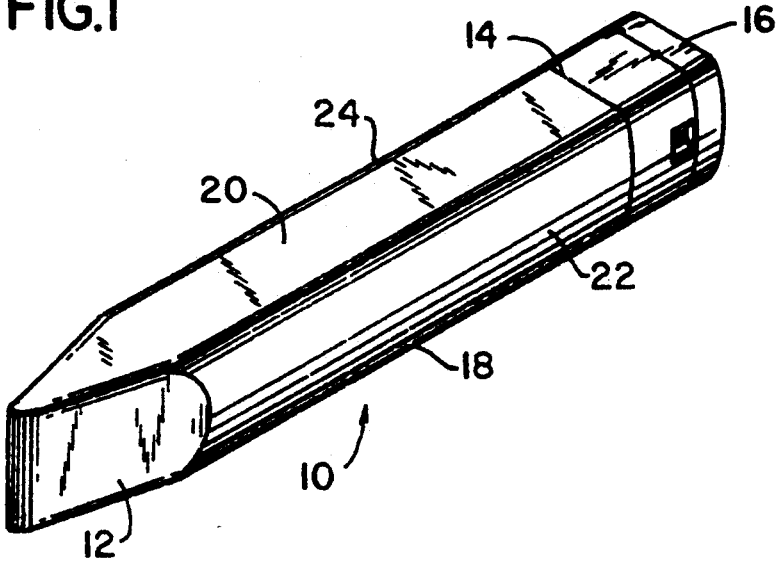
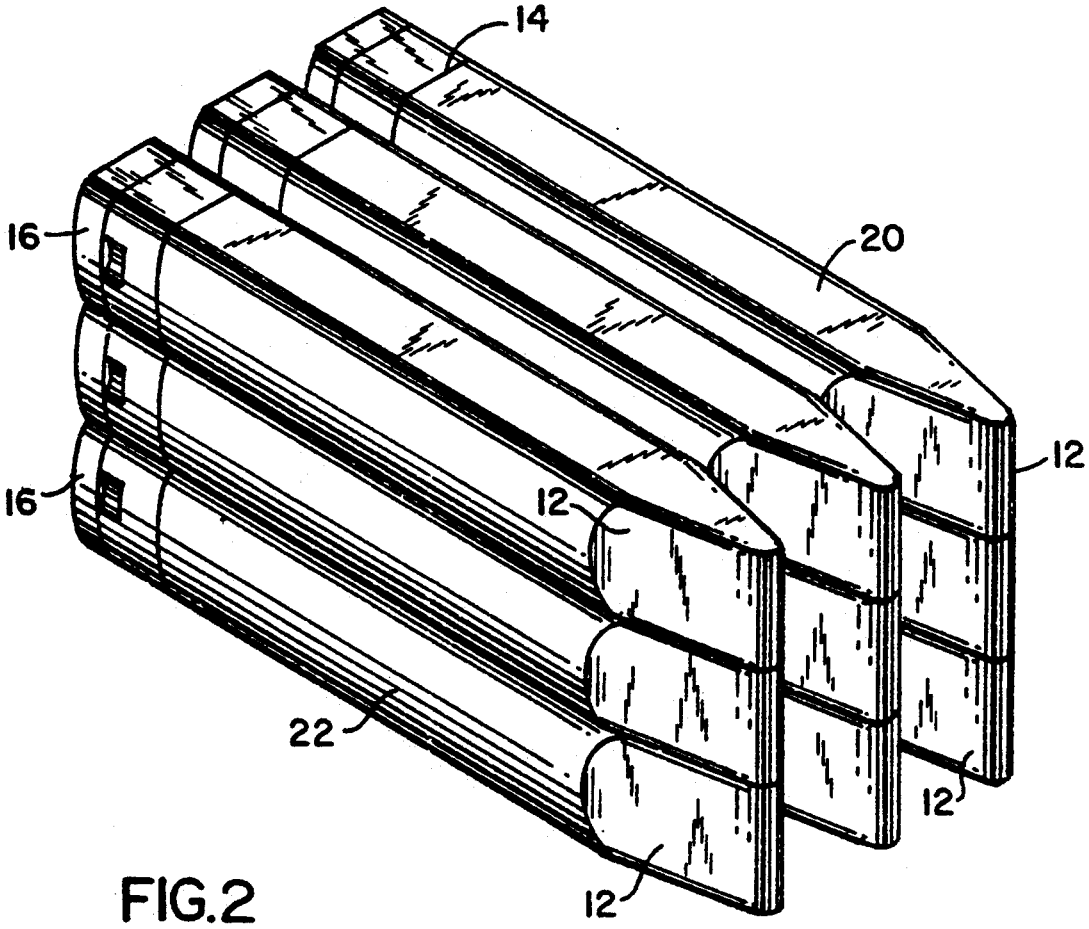
FIG.2

FIG.3
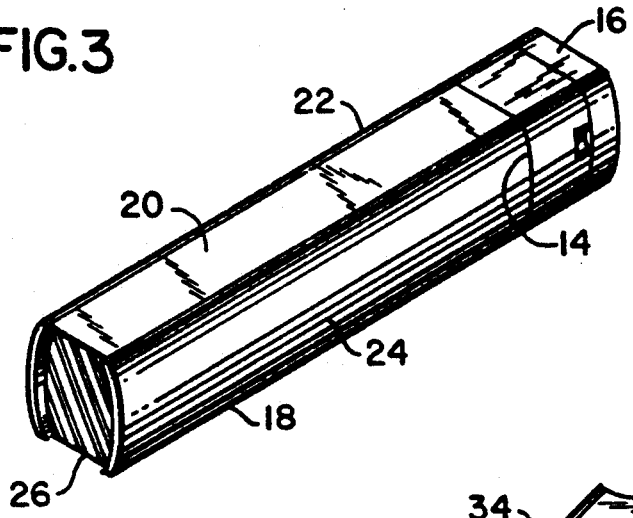
FIG.4
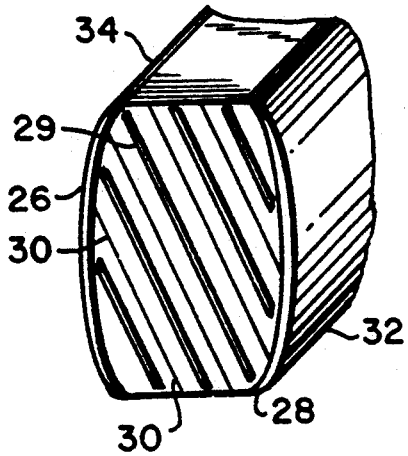
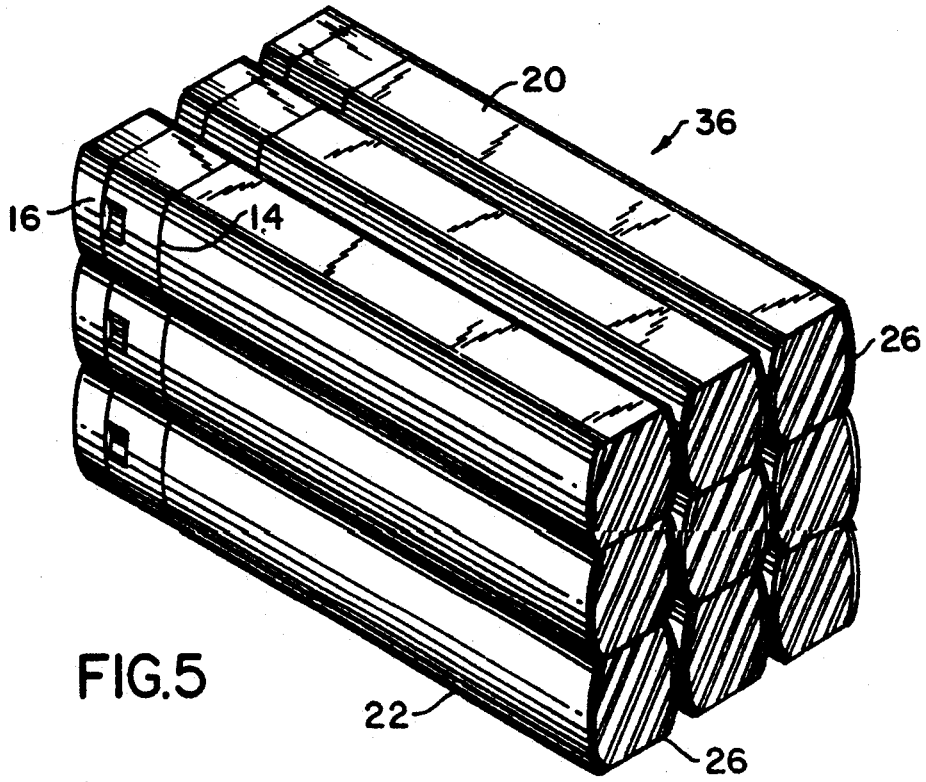
FIG.5

STACKABLE TOOTHPASTE TUBE

The present invention relates to a rectangular-oval shaped toothpaste tube which can be horizontally positioned on a shelf and upon which a multiplicity of tubes can be stacked so that the entire vertical height of the space between the shelves can be utilized. Each of the tubes is also provided with a broad flat cap so that in the alternative, the toothpaste tubes may be positioned on the shelves in a vertical manner.

BACKGROUND OF THE INVENTION

In the past, toothpaste tubes commonly came in cartons, however new federal and state regulations and laws relating to the environment require less packaging for products to be sold to the consumer. Consequently, it is extremely desirable to eliminate the outer packaging or carton of the toothpaste tube.

One attempt to solve this problem of excess packaging is the stand up toothpaste tube, which is without a carton and is displayed vertically on the shelf. Since the tube is balanced on the small cap surface, and shelf space is at a premium in stores selling such products, toothpaste tubes are arranged very close together. The tubes can be very easily tipped over with the disadvantage that the brand name on the front panel may be hidden. Furthermore, customers, while reaching in to pick out a single tube among the closely stacked standing tubes will often cause many of the tubes to fall down on or off the shelf. Furthermore, this arrangement only allows a single layer to be displayed in the allotted shelf space. This is a drawback as it is well known in the trade that shelf space is strictly allotted in stores such as supermarkets and drug stores. Thus, it should be clear that the prior art standup tubes when arranged closely stacked vertically, are unstable. Consequently, the display is easily disturbed by customers when making a selection. Moreover, maximizing the allotted shelf space is not accomplished.

SUMMARY OF THE INVENTION

The present invention relates to a rectangular-oval tube which can be stacked on it's narrow flat panel in a horizontal orientation on the shelf with the wide panel showing the brand name, and possibly a logo facing the customer. Consequently, the horizontally arranged tubes can be stacked, one upon the other, and thus utilizing the full shelf height of the allotted space, so that more product can be displayed on the shelf in a neat and stable manner.

It is a feature of the present invention to provide a tube, preferably for toothpaste, which has a thickness in the range of 0.006–0.010 inches. This relatively thin wall allows the tube body to fully collapse when squeezed. The stacking sides of each toothpaste tube are parallel to each other and the tubes themselves are fully recyclable.

Another object of the present invention is to provide curvilinear front and rear surfaces on a toothpaste tube so that large areas on those surfaces can be provided for indicia, and a possible logo related to the product.

It is a further object of the present invention to provide a collapsible tube having multiple layers including a barrier layer for preventing product oxidation and product permeation loss.

It is another object of the present invention to provide a blow-molded collapsible rectangular-oval tube with it's base molded in diagonal, parallel accordion pleats so the tube can collapse easily when squeezed.

A further feature of the present invention is to provide a toothpaste tube with a molded base which can be filled from the top by molding a large neck area to accommodate a filler nozzle. The bottom of the tube, which is v-shaped, is molded in the blow molding machine, thus eliminating the possibility of product leaking out of the tube which often occurs when the bottom is heat sealed.

The foregoing objects and features of my invention will be more fully understood by the following description of the construction in the specification and by reference to the accompanying drawings forming a part hereof in which:

BRIEF DESCRIPTION OF THE DRAWINGS

FIG. 1 is a perspective view a of a cartonless stackable toothpaste tube constructed in accordance with the teachings of my invention.

FIG. 2 is a perspective view of a plurality of toothpaste tubes stacked horizontally with brand identification facing forward.

FIG. 3 is a perspective view showing an alternate embodiment of my invention shown in FIG. 1.

FIG. 4 is a partial perspective view of the base of a toothpaste tube shown in FIG. 3 showing the parting line and adjacent accordion pleats which permits the base to fully collapse when squeezed, and;

FIG. 5 is a perspective view showing a multiplicity of toothpaste tubes of the type shown in FIG. 3 stacked horizontally with the brand identification facing forward.

DESCRIPTION OF THE PREFERRED EMBODIMENTS

The cartonless squeezable toothpaste tube shown in FIG. 1 is referred to generally by the reference numeral 10. The toothpaste tube is perfectly fabricated by a blow molding technique wherein the wedge shaped bottom 12 is molded in. The relatively large open top 14 is provided with a cap 16. The cap has a top surface 18 which is flat so the tube can be stood on it's cap when not in use. This has a desirable effect of insuring that the product in the tube falls by gravity into the top of the tube so that when it is required to use the toothpaste the product is immediately available.

The relatively narrow bottom panel 18 and top panel 20 are flat and parallel to each other. The front and side panel 22 as well as the rear side panel 24, are larger, and have more surface area than the top and bottom panels 18 and 20. The panels 18 and 20 are flat and parallel to each other and extends along the entire surface from the top 14, including the cap 16 to the extreme end of the wedge-shaped bottom 12.

As seen in FIG. 2, the toothpaste tubes 10 can be stacked horizontally in a series of rows to a selected height in the opening between the vertically spaced shelves for product display in a store.

As the present blow molded collapsible rectangular-oval tube is provided with a relatively thin multi-ply wall, being a thickness in the order of 0.006–0.010 inches, this thin wall allows the tube base to fully collapse when squeezed, and as a result a suck back of air after dispensing the toothpaste is not a problem, as is the case in relatively thick walled toothpaste tubes.

The fact that the wedge shaped bottom of the toothpaste tube is molded and not heat sealed also eliminates the possibility of leakage of the toothpaste product which often occurs in the heat sealed bottom of a toothpaste tube.

The multi-walled thin tube is provided with a barrier liner of the type that prevents oxygen penetration into the interior tube which would deteriorate the toothpaste compound therein.

FIGS. 3–5 show an alternate embodiment of the present invention in which like components shown in FIGS. 1 and 2 bear the same reference numerals. In the present alternate embodiment, the base 26 is flat and as shown in FIG. 3 is provided with a diagonal pinch off 28 being from an edge 32 at the bottom of the tube to an opposite edge 34 at the top of the tube. Adjacent to the pinch-off are accordion pleats 30 which together with the relatively thin wall of the tube insures that the tube base will fully collapse when squeezed. Furthermore, the diagonal pinch-off on the base allows the parting line 29 to show on opposite corners only, thus leaving the side panels for uninterrupted printing.

As seen in FIG. 5, the toothpaste tubes refer to generally by the reference numerals 36 are stacked horizontally on a shelf. The vertical height of the shelf can be selected depending on the number of toothpaste tubes that one wishes to display on the allotted shelf space. It should be apparent that the present invention maximizes the shelf distribution space allotted to any particular vendor. Furthermore, the toothpaste tube without a carton satisfies the new federal and state environmental regulations tending to eliminate as much packaging as possible in the display and sale of products. Thus the present invention contemplates the fabrication of fully recyclable and stackable toothpaste tubes provided with thin walls which will collapse after squeezing.

While the present invention has been disclosed and described with reference to certain embodiments thereof, it is apparent that other variations and modifications may be made which fall within the true scope of the invention, as defined in the following claims.

What I claim is:

1. A blow-molded stackable toothpaste tube having a wedge-shaped bottom, opposite flat and parallel side panels, front and back panels each having a larger surface area than either of the side panels, wherein said front and back panels connect at a bottom narrow ends of the wedge-shaped bottom, a relatively large top opening for filling the tube with product, said flat and parallel side panels each having a flat linear surface extending from the top opening to said bottom narrow end of said wedge-shaped bottom wherein the tube is vertically stackable along its respective side panels, with the side panels of identical tubes engageable along their entire flat linear surfaces, said tube being provided with a multi-layered wall having a thickness in the range of 0.006 to 0.010 inches, wherein said tube being laterally stackable with another tube horizontally on a shelf.

2. A toothpaste tube as claimed in claim 1 further comprising a flat cap for said top opening having such dimensions as to permit said tube to be placed on a shelf standing on said cap.

3. A toothpaste tube as claimed in claim 1 wherein said front and back panels are curvilinear in order to provide more printing space for brand identification.

4. A toothpaste tube as claimed in claim 1 wherein said tube is fabricated of a recycleable plastic material.

* * * * *